US009227639B1

(12) United States Patent
Bryant et al.

(10) Patent No.: US 9,227,639 B1
(45) Date of Patent: Jan. 5, 2016

(54) SYSTEM AND METHOD FOR DECOUPLING A VEHICLE SYSTEM

(71) Applicant: General Electric Company, Schenectady, NY (US)

(72) Inventors: Robert Francis Bryant, Melbourne, FL (US); Jared Klineman Cooper, Melbourne, FL (US); Frank Wawrzyniak, Melbourne, FL (US); Tara Lauren Wawrzyniak, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 6 days.

(21) Appl. No.: 14/326,534

(22) Filed: Jul. 9, 2014

(51) Int. Cl.
*B61L 3/00* (2006.01)
*B61L 15/00* (2006.01)

(52) U.S. Cl.
CPC ..... *B61L 3/00* (2013.01); *B61L 15/0018* (2013.01)

(58) Field of Classification Search
CPC ..... B61L 3/00; B61L 3/006; B61L 15/0018; B61L 15/0027; B61L 15/0072
See application file for complete search history.

(56) References Cited

U.S. PATENT DOCUMENTS

| | | | |
|---|---|---|---|
| 5,720,455 | A | 2/1998 | Kull et al. |
| 5,738,311 | A | 4/1998 | Fernandez |
| 5,740,547 | A | 4/1998 | Kull et al. |
| 5,785,392 | A | 7/1998 | Hart |
| 5,813,635 | A | 9/1998 | Fernandez |
| 5,820,226 | A | 10/1998 | Hart |
| 5,833,325 | A | 11/1998 | Hart |
| 5,927,822 | A | 7/1999 | Hart |
| 5,934,764 | A | 8/1999 | Dimsa et al. |
| 5,950,967 | A | 9/1999 | Montgomery |

(Continued)

FOREIGN PATENT DOCUMENTS

| | | | |
|---|---|---|---|
| AU | 741050 | B2 | 11/2001 |
| CA | 2283695 | A1 | 9/1998 |

(Continued)

OTHER PUBLICATIONS

"A Global Control Strategy for Urban Vehicles Platooning relying on Nonlinear Decoupling Laws"; authored by j. Bom; Retrieved on Aug. 28, 2015; authored Aug. 2-6, 2005; http://ieeexplore.ieee.org/stamp/stamp.jsp?tp=&arnumber=1545270.*

(Continued)

*Primary Examiner* — James Trammell
*Assistant Examiner* — James E Stroud
(74) *Attorney, Agent, or Firm* — GE Global Patent Operation; John A. Kramer

(57) ABSTRACT

A system and method for separating a vehicle system into separate vehicle segments, separately moving the vehicle segments, and re-connecting the vehicle segments without initiation of a brake penalty application are provided. The system and method communicate a suspend command signal between vehicle segments to suspend operations of vehicles in a cooperative mode. The vehicles in the vehicle system are decoupled into plural separate vehicle segments. The system and method also move one or more of the vehicle segments separately from one or more other vehicle segments. The vehicle segments are reconnected to form the vehicle system, and the system and method communicate a reconnect command signal between the vehicle segments to resume operations in the cooperative mode, without incurring a penalty brake application of the vehicle system.

22 Claims, 4 Drawing Sheets

(56) References Cited

U.S. PATENT DOCUMENTS

| | | | |
|---|---|---|---|
| 5,969,643 | A | 10/1999 | Curtis |
| 5,978,718 | A | 11/1999 | Kull |
| 5,986,577 | A | 11/1999 | Bezos |
| 5,986,579 | A | 11/1999 | Halvorson |
| 5,995,881 | A | 11/1999 | Kull |
| 6,095,618 | A | 8/2000 | Heneka et al. |
| 6,114,974 | A | 9/2000 | Halvorson |
| 6,128,558 | A | 10/2000 | Kernwein |
| 6,135,396 | A | 10/2000 | Whitfield et al. |
| 6,163,089 | A | 12/2000 | Kull |
| 6,216,095 | B1 | 4/2001 | Glista |
| 6,275,165 | B1 | 8/2001 | Bezos |
| 6,322,025 | B1 | 11/2001 | Colbert et al. |
| 6,360,998 | B1 | 3/2002 | Halvorson et al. |
| 6,377,215 | B1 | 4/2002 | Halvorson et al. |
| 6,434,452 | B1 | 8/2002 | Gray |
| 6,443,538 | B1 | 9/2002 | Smith et al. |
| 6,505,103 | B1 | 1/2003 | Howell et al. |
| 6,759,951 | B2 | 7/2004 | Kellner et al. |
| 6,763,291 | B1 | 7/2004 | Houpt et al. |
| 6,782,044 | B1 | 8/2004 | Wright et al. |
| 6,824,226 | B2 | 11/2004 | Smith et al. |
| 6,854,691 | B2 | 2/2005 | Kraeling et al. |
| 6,862,502 | B2 | 3/2005 | Peltz et al. |
| 6,866,347 | B2 | 3/2005 | Smith et al. |
| 6,922,619 | B2 | 7/2005 | Baig et al. |
| 6,937,925 | B2 | 8/2005 | Smith |
| 6,997,418 | B1 | 2/2006 | Sanzone |
| 7,131,614 | B2 | 11/2006 | Kisak et al. |
| 7,162,337 | B2 | 1/2007 | Peltz et al. |
| 7,263,647 | B2 | 8/2007 | Bryant et al. |
| 7,302,895 | B2 | 12/2007 | Kumar et al. |
| 7,395,141 | B1 | 7/2008 | Seck et al. |
| 7,416,262 | B2 | 8/2008 | Ring |
| 7,628,458 | B2 | 12/2009 | Smith et al. |
| 7,664,459 | B2 | 2/2010 | Smith et al. |
| 7,671,570 | B2 | 3/2010 | Larsen |
| 7,706,157 | B2 | 4/2010 | Pearson et al. |
| 7,762,631 | B2 | 7/2010 | Smith |
| 7,783,397 | B2 | 8/2010 | Peltz et al. |
| 7,869,908 | B2 | 1/2011 | Walker |
| 7,949,441 | B2 | 5/2011 | Baig et al. |
| 7,983,805 | B2 | 7/2011 | Bryant |
| 8,073,582 | B2 | 12/2011 | Kellner et al. |
| 8,078,376 | B2 | 12/2011 | Kumar |
| 8,112,189 | B2 | 2/2012 | Peltz et al. |
| 8,126,601 | B2 | 2/2012 | Kapp et al. |
| 8,157,218 | B2 | 4/2012 | Riley et al. |
| 8,190,311 | B2 | 5/2012 | Smith |
| 8,190,313 | B2 | 5/2012 | Moffitt et al. |
| 8,190,314 | B2 | 5/2012 | Smith et al. |
| 8,190,315 | B2 | 5/2012 | Kraeling et al. |
| 8,224,237 | B2 | 7/2012 | Smith et al. |
| 8,224,591 | B2 | 7/2012 | Smith et al. |
| 8,229,350 | B2 | 7/2012 | Smith et al. |
| 8,229,607 | B2 | 7/2012 | Hrdlicka et al. |
| 8,239,078 | B2 | 8/2012 | Siddappa et al. |
| 8,249,763 | B2 | 8/2012 | Brooks et al. |
| 8,280,566 | B2 | 10/2012 | Foy, III et al. |
| 8,280,567 | B2 | 10/2012 | Brand et al. |
| 8,280,569 | B2 | 10/2012 | Kumar et al. |
| 8,285,429 | B2 | 10/2012 | Kumar |
| 8,290,645 | B2 | 10/2012 | Chandra et al. |
| 8,310,979 | B2 | 11/2012 | Mason et al. |
| 8,328,144 | B2 | 12/2012 | Smith |
| 8,328,145 | B2 | 12/2012 | Smith |
| 8,364,338 | B2 | 1/2013 | Peltonen et al. |
| 8,370,006 | B2 | 2/2013 | Kumar et al. |
| 8,406,941 | B2 | 3/2013 | Smith |
| 8,406,942 | B2 | 3/2013 | Siddappa et al. |
| 8,406,943 | B2 | 3/2013 | Brand et al. |
| 8,428,798 | B2 | 4/2013 | Kull |
| 8,473,127 | B2 | 6/2013 | Daum et al. |
| 8,500,214 | B2 | 8/2013 | Smith et al. |
| 8,504,226 | B2 | 8/2013 | Brooks et al. |
| 8,504,272 | B2 | 8/2013 | Kumar |
| 8,521,447 | B2 | 8/2013 | Smith et al. |
| 8,522,690 | B2 | 9/2013 | Smith et al. |
| 8,538,608 | B2 | 9/2013 | Meltser et al. |
| 8,565,946 | B2 | 10/2013 | Cooper et al. |
| 8,589,000 | B2 | 11/2013 | Moffitt et al. |
| 8,589,001 | B2 | 11/2013 | Siddappa et al. |
| 8,626,058 | B2 | 1/2014 | Smith et al. |
| 8,649,916 | B2 | 2/2014 | Woo et al. |
| 8,655,521 | B2 | 2/2014 | Brooks et al. |
| 8,682,513 | B2 | 3/2014 | Chen et al. |
| 2005/0121971 | A1 | 6/2005 | Ring |
| 2007/0219680 | A1 | 9/2007 | Kumar et al. |
| 2007/0225878 | A1 | 9/2007 | Kumar et al. |
| 2007/0233335 | A1 | 10/2007 | Kumar et al. |
| 2007/0241610 | A1 | 10/2007 | Smith |
| 2008/0128562 | A1 | 6/2008 | Kumar et al. |
| 2009/0090818 | A1 | 4/2009 | Kumar |
| 2009/0248226 | A1 | 10/2009 | Kellner et al. |
| 2010/0023190 | A1 | 1/2010 | Kumar et al. |
| 2010/0029209 | A1 | 2/2010 | Daum et al. |
| 2010/0030409 | A1 | 2/2010 | Smith et al. |
| 2010/0070116 | A1 | 3/2010 | Kumar et al. |
| 2010/0130124 | A1 | 5/2010 | Teeter et al. |
| 2010/0204856 | A1 | 8/2010 | Smith et al. |
| 2011/0118899 | A1 | 5/2011 | Brooks et al. |
| 2011/0249628 | A1 | 10/2011 | Peltz et al. |
| 2012/0095626 | A1 | 4/2012 | Smith |
| 2012/0259486 | A1 | 10/2012 | Hrdlicka et al. |
| 2012/0276841 | A1 | 11/2012 | Mason et al. |
| 2012/0277940 | A1 | 11/2012 | Kumar et al. |
| 2012/0290156 | A1 | 11/2012 | Woo et al. |
| 2012/0303237 | A1 | 11/2012 | Kumar et al. |
| 2012/0318931 | A1 | 12/2012 | Cooper et al. |
| 2012/0323412 | A1 | 12/2012 | Chandra et al. |
| 2013/0029719 | A1 | 1/2013 | Choi et al. |
| 2013/0035811 | A1 | 2/2013 | Schroeck et al. |
| 2013/0102333 | A1 | 4/2013 | Dam |
| 2013/0131898 | A1 | 5/2013 | Kumar et al. |
| 2013/0168503 | A1 | 7/2013 | Cooper et al. |
| 2013/0277505 | A1 | 10/2013 | Kumar et al. |
| 2013/0317676 | A1 | 11/2013 | Cooper et al. |
| 2014/0005915 | A1 | 1/2014 | Smith et al. |

FOREIGN PATENT DOCUMENTS

| | | | |
|---|---|---|---|
| CA | 2791534 | A1 | 3/2014 |
| CA | 2826394 | A1 | 3/2014 |
| EP | 1119483 | A1 | 8/2001 |
| WO | 9960735 | A1 | 11/1999 |
| WO | 2010039680 | A1 | 4/2010 |
| ZA | 200101708 | A1 | 8/2001 |

OTHER PUBLICATIONS

"Communication and metrics in agent convoy organization"; authored by Vincent Baines; Retrieved on Aug. 28, 2015; http://www.ia.urjc.es/att2012/papers/att2012_submission_19.pdf.*

Knight, Will; "10-4, Good Computer: Automated System Lets Trucks Convoy as One", May 28, 2014; Trucks Convoy under Computer Control to Save Gas/MIT Technology Review; www.technologyreview.com/news/527476, (5 pgs.).

* cited by examiner

SYSTEM AND METHOD FOR DECOUPLING A VEHICLE SYSTEM

FIELD

Embodiments of the subject matter disclosed herein relate to controlling vehicle systems having two or more propulsion-generating vehicles that are logically and/or mechanically coupled with each other.

BACKGROUND

Vehicle systems can include two or more propulsion-generating vehicles that coordinate movements with each other. With respect to rail vehicles, consists or trains can include two or more locomotives and one or more rail cars. The locomotives can coordinate movements with each other to avoid tearing the consists or trains apart. For example, one locomotive can remotely control movements of another locomotive.

The consist or train may have a brake pipe that extends through the length of the consist or train. Reducing pressure in this pipe can cause air brakes to be applied in the consist or train, which slows and/or stops movement of the consist or train. Once the air brakes are applied, continued movement of the consist or train may be prevented until air pressure in the brake pipe and/or a rate of air flow in the brake pipe increases above one or more designated thresholds.

The consist or train can include a safety feature referred to as a penalty brake application. This safety feature includes dropping air pressure in the brake pipe sufficiently far to apply the air brakes and prevent movement of the consist or train when one or more events occur. One of these events includes decoupling two or more locomotives or rail cars from each other. When this occurs, a penalty brake application is initiated to prevent movement of the locomotives or rail cars. This movement is prevented until the air pressure and/or rate of air flow in the brake pipe increases above some designated threshold.

In very cold environments, the time needed to increase the air pressure and/or rate of air flow in a brake pipe can take a considerably long time. During the loading and/or unloading of cargo from rail cars in a consist or train, the rail cars may need to be separated from the rest of the consist or train. As a result, a penalty brake application occurs. The cargo may be loaded and/or unloaded, and the rail cars may be reconnected in the consist or train. Because of the prolonged time period needed to pump up the air pressure and/or rate of air flow in the brake pipe due to the cold environment, however, the consist or train may sit idle for an unnecessarily long period of time.

BRIEF DESCRIPTION

In one embodiment, a method (e.g., for decoupling a vehicle system) includes, onboard a vehicle system comprising plural propulsion-generating vehicles coupled together and operating in a cooperative mode, communicating a suspend command signal between two or more of the propulsion-generating vehicles to suspend operations of the propulsion-generating vehicles in the cooperative mode, decoupling the propulsion-generating vehicles in the vehicle system into plural separate vehicle segments, moving one or more of the vehicle segments separately from one or more other vehicle segments, reconnecting the vehicle segments to form the vehicle system, and communicating a reconnect command signal between the vehicle segments to resume operations of the propulsion-generating vehicles in the cooperative mode.

The propulsion-generating vehicles are decoupled from each other, moved separately from each other in the vehicle segments, and reconnected in the vehicle segments to form the vehicle system without incurring a penalty brake application of the vehicle system.

In another embodiment, a system (e.g., a command system) includes a controller (e.g., a first controller) configured to be disposed onboard a leading propulsion-generating vehicle of a vehicle system that includes one or more remote propulsion-generating vehicles coupled together and operating in a cooperative mode. The controller is configured to communicate a suspend command signal to the one or more remote propulsion-generating vehicles to suspend operations of the leading and remote propulsion-generating vehicles in the cooperative mode. The leading and remote propulsion-generating vehicles in the vehicle system are decoupled from each other into plural separate vehicle segments responsive to communication of the suspend command signal. The controller also is configured, responsive to the vehicle segments being reconnected to form the vehicle system after the vehicle segments are moved separately from one another, to communicate a reconnect command signal to the one or more remote propulsion-generating vehicles to resume operations of the propulsion-generating vehicles in the cooperative mode. The first controller is configured to avoid a penalty brake application of the vehicle system responsive to the propulsion-generative vehicles being decoupled from each other, moving separately from each other in the vehicle segments, or being reconnected with each other in the vehicle segments to form the vehicle system.

In another embodiment, a method (e.g., for decoupling a vehicle system) includes controlling movement of a remote propulsion-generating vehicle in a vehicle system that includes at least a leading propulsion-generating vehicle coupled with the remote propulsion-generating vehicle. The movement of the remote propulsion-generating vehicle is controlled based on operational command signals received from the leading propulsion-generating vehicle. The method also can include suspending control of the movements of the remote propulsion-generating vehicle based on the operational command signals responsive to receiving a suspend command signal at the remote propulsion-generating vehicle and, responsive to confirming suspension of control of the movements of the remote propulsion-generating vehicle based on the operational command signals, separating the vehicle system into a leading vehicle segment that includes the leading propulsion-generating vehicle and a remote vehicle segment that includes the remote propulsion-generating vehicle. The method may further include moving the remote vehicle segment separately from movement of the leading vehicle segment, connecting the remote vehicle segment with the leading vehicle segment to form the vehicle system, and resuming control of the movement of the remote propulsion-generating vehicle based on the operational command signals received from the leading propulsion-generating vehicle.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

One or more embodiments described herein include systems and methods for decoupling a vehicle system into two or more separate vehicle systems that can independently move relative to each other, without incurring a brake penalty at the vehicle systems. In one example, a rail vehicle system (e.g., a train) can be operating in a cooperative mode where the operations of one or more propulsion-generating vehicles (e.g., locomotives) are coordinated with each other. One example of a cooperative mode is a distributed power (DP) mode, where the operations of one or more propulsion-generating vehicles are remotely controlled from another propulsion-generating vehicle in the same vehicle system. The vehicle system may be mechanically and/or logically split up into two or more separate segments, with at least two of the segments each having one or more propulsion-generating vehicles. The segments may then be separately controlled (e.g., both throttle and brake operations) from each other. The segments optionally can be re-combined into the same or different larger vehicle system, without incurring a brake penalty.

At least one technical effect of the subject matter described herein allows for coordinated control of several propulsion-generating vehicles of a vehicle system during a first time period, followed by mechanically, fluidly, and/or logically decoupling the vehicles in the vehicle system from each other, separately controlling separated segments of the vehicle system, and then reconnecting the segments into the vehicle system and returning to coordinated control of the vehicle system, without a penalty brake application of the vehicle system. Previous attempts to separate a vehicle system into separate segments resulted in a penalty brake application, which can take a significant time to recover from following reconnection of the segments into the larger vehicle system. The subject matter described herein provides novel and non-obvious solutions to the problem of long recovery times following reconnection of separate vehicle segments into a larger vehicle system.

Figure 1:
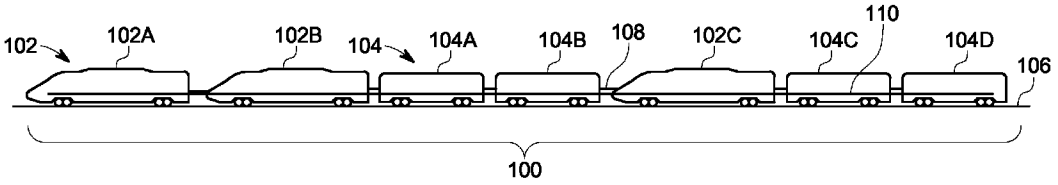
FIG. 1 illustrates a vehicle system according to one embodiment.

FIG. 1 illustrates a vehicle system 100 according to one embodiment. The vehicle system 100 includes two or more propulsion-generating vehicles 102 (e.g., vehicles 102A-C) and one or more non-propulsion-generating vehicles 104 (e.g., vehicles 104A-D). The vehicles 102, 104 are linked together to travel along a route 106. For example, the vehicles 102, 104 may be mechanically connected with each other by couplers 108. The vehicle system 100 is shown as a rail vehicle system having locomotives as the vehicles 102 and railcars as the vehicles 104 (e.g., a train), but optionally may be formed of different vehicles 102, 104. The number and/or arrangement of the vehicles 102, 104 in the vehicle system 100 is only one example, and may differ from what is shown in FIG. 1.

The vehicle system 100 may travel along the route 106 in a DP mode, where operations of the propulsion-generating vehicles 102 are controlled from one or more other vehicles 102 in the same vehicle system 100. For example, the vehicle 102A (or another vehicle 102) may communicate command signals (e.g., via wired connections and/or wirelessly) to the vehicles 102B-C (or other vehicles 102). The vehicle 102 that is controlling the operations of other vehicles 102 may be referred to as a lead or controlling vehicle 102, even if the vehicle 102 is not disposed at the head of the vehicle system 100 along a direction of travel. The vehicles 102 that are controlled by the lead or controlling vehicle 102 may be referred to as remote or controlled vehicles 102.

The command signals can include operational command signals that direct the operational settings of the vehicles 102 (e.g., throttle settings, brake settings, or the like), that are to be used by the different vehicles 102 at different locations along the route 106. In one aspect, the operational settings commanded by the lead vehicle 102 are the same for two or more, or all, of the remote vehicles 102. This manner of operations in the DP mode can be referred to as synchronous DP mode. In another aspect, the operational settings may differ for two or more of the vehicles 102 at a common time. This manner of operations can be referred to as asynchronous DP mode.

A brake line 110 extends through all or a substantial part of the vehicle system 100. The brake line 110 fluidly couples brake systems disposed onboard the vehicles 102 and/or the vehicles 104. For example, the brake line 110 can be at least partially filled with a fluid, such as air or another gas, above a threshold pressure level to prevent brakes of the vehicles 102 and/or the vehicles 104 from being applied. The pressure of this fluid in the brake line 110 can be reduced below the threshold pressure level to cause the brakes to be applied. In the state of the vehicle system 100 shown in FIG. 1, the brake line 110 may be a fluidly continuous conduit such that the fluid in the brake line 110 can flow from one end of the brake line 110 (e.g., in the vehicle 102A) to the other end of the brake line 110 (e.g., in the vehicle 104D).

In order to separate the vehicle system 100 into two or more separate segments, the DP mode of the vehicle system 100 can be suspended. The lead propulsion-generating vehicle 102 can communicate (e.g., broadcast and/or transmit) a suspend command signal to the remote propulsion-generating vehicles 102. This suspend command signal can be communicated wirelessly and/or via one or more wired connections between the vehicles 102 (e.g., one or more cables, buses, lines, or the like, such as a multiple unit line, trainline, etc.). The suspend command signal instructs the remote vehicles 102 to stop operating in the DP mode, such as by preventing command signals subsequently received from the lead vehicle 102 from changing operational settings of the remote vehicles 102. The vehicles 102 may then be operated in a non-DP mode, such as by operating in an independent mode, where operations of one or more of the vehicles 102 are not controlled by another vehicle 102.

In response to receiving the suspend command signal, the remote vehicles 102 optionally may apply brakes of the remote vehicles 102. For example, brakes disposed onboard the propulsion-generating vehicles 102 may be applied. These brakes can be referred to as independent brakes. Optionally, brakes of the non-propulsion-generating vehicles 104 may be applied. These brakes may be referred to as automatic brakes, such as an automatic train brake.

Figure 2:
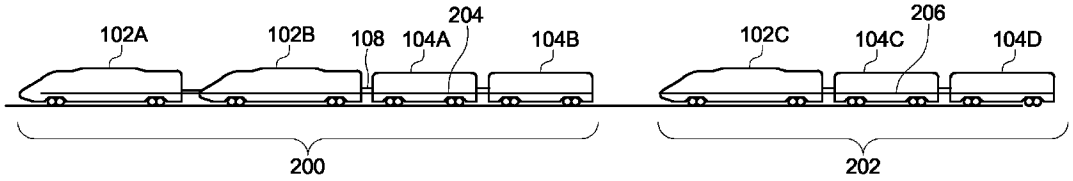
FIG. 2 illustrates the vehicle system shown in FIG. 1 separated into two or more vehicle segments according to one embodiment.

FIG. 2 illustrates the vehicle system 100 shown in FIG. 1 separated into two or more vehicle segments 200, 202 according to one embodiment. While the vehicle system 100 is shown as being divided into two vehicle segments 200, 202, optionally, the vehicle system 100 may be divided into three or more vehicle segments. The vehicle system 100 can be separated into the vehicle segments 200, 202 responsive to the DP mode of the vehicle system 100 being suspended and/or brakes of the vehicles 102 and/or the vehicles 104 in the vehicle segments 200, 202 being applied. This can ensure that control of the different vehicle segments 200, 202 is localized (e.g., each vehicle segment 200, 202 is controlled by a vehicle 102 that is in the vehicle segment 200, 202) and/or that each vehicle segment 200, 202 cannot move if a command signal is received from a source outside of the vehicle segment 200, 202.

The vehicle system 100 can be separated into the separate vehicle segments 200, 202 by separating the coupler 108 between the segments 200, 202 from one or more of the vehicles 102, 104. For example, the coupler 108 between the vehicle 104B and the vehicle 102C may be separated from one or more, or both, of the vehicles 104B, 102C. This separation of the vehicle system 100 can be referred to as a mechanical decoupling of the vehicle system 100.

The separation of the vehicle system 100 into the vehicle segments 200, 202 optionally can include fluidly decoupling the vehicle system 100. The fluid decoupling of the vehicle system 100 can involve separating the brake line 110 (shown in FIG. 1) of the vehicle system 100 into separate brake line segments 204, 206. The brake line segments 204, 206 can be disposed in different vehicles 102, 104 of the different vehicle segments 200, 202 to fluidly couple brakes of the vehicles 102, 104 in each of the vehicle segments 200, 202 with each other. For example, the brake line segment 204 can fluidly couple the brakes of the vehicles 102A, 102B, 104A, 104B in the vehicle segment 200 and the brake line segment 206 can fluidly couple the brakes of the vehicles 102C, 104C, 104D of the vehicle segment 202. But, the brake line segment 204 may be separate (e.g., fluidly decoupled) from the brake line segment 206 such that the fluid in the segment 204 cannot flow into the segment 206, and the fluid in the segment 206 cannot flow into the segment 204.

Once the vehicle system 100 is separated into the separate vehicle segments 200, 202, different propulsion-generating vehicles 102 in the different segments 200, 202 may separately control movements of the segments 200, 202. For example, the vehicle 102A can communicate command signals to the vehicle 102B to control movement of the segment 200 or the vehicle 102A can control movement of the segment 200 without contribution by the vehicle 102B.

In one embodiment, prior to a propulsion-generating vehicle 102C in the other segment 202 controlling movement of the segment 202, the vehicle 102C can require verification that the DP mode of the vehicle system 100 is suspended or is no longer operable to allow movement of a segment 200 or 202 to be remotely controlled by any propulsion-generating vehicle 102 in another segment 202 or 200. This verification can involve an operator onboard a vehicle 102 in a segment 200, 202 checking operations of the segment 200, 202 to ensure that the DP mode has been suspended on the vehicle 102. For example, the operator may visually examine one or more display screens onboard the vehicle 102 to determine if the vehicle 102 is operating in or out of the DP mode. Optionally, the vehicle 102 may prevent the operator from changing operational settings of the vehicle 102 until the operator uses an input device onboard the vehicle 102 to confirm that the vehicle 102 is no longer operating in the DP mode.

The vehicle segments 200, 202 can now move separately from each other. For example, one or more of the propulsion-generating vehicles 102 in the segment 200 can control throttle settings and/or brake settings to move or stop movement of the segment 200, while one or more of the propulsion-generating vehicles 102 in the segment 202 can independently control throttle settings and/or brake settings to move or stop movement of the segment 202. In one aspect, one of the segments 200 or 202 may remain stationary while another segment 202 or 200 moves for one or more operations, such as a loading or unloading operation of cargo from the non-propulsion-generating vehicles 104.

Because the continuous brake line 108 shown in FIG. 1 has been separated into the fluidly decoupled brake line segments 204, 206, each vehicle segment 200, 202 can separately control the brakes in the vehicle segment 200, 202. For example, the vehicle segment 200 can reduce pressure in the brake line segment 204 to apply the brakes in the vehicle segment 200 without the vehicle segment 202 reducing the pressure in the brake line segment 206.

The vehicle segments 200, 202 may then re-couple with each other and/or the brake line segments 204, 206 may re-couple with each other to form the vehicle system 100 shown in FIG. 1. Optionally, one or more vehicles 102, 104 may be added to or removed from one or more of the vehicle segments 200, 202 such that, when the vehicle segments 200, 202 are combined into the vehicle system 100, the arrangement and/or number of one or more vehicles 102, 104 in the vehicle system 100 is different from the vehicle system 100 prior to separating into the segments 200, 202.

In one embodiment, the vehicle segments 200, 202 move toward each other so that the segments 200, 202 can be connected by one or more couplers 108 (shown in FIG. 1). The brake line segments 204, 206 optionally may be fluidly coupled with each other such that the brake pipe 110 shown in FIG. 1 is formed again. In order to switch back to the DP mode, one or more of the vehicles 102 can send a reconnect command signal to the lead vehicle 102. For example, an operator onboard the vehicle 102C (which formerly was in a different segment 202 than the lead vehicle 102A) can direct the vehicle 102C to communicate the reconnect command signal to the lead vehicle 102A. Optionally, the reconnect command signal may be automatically communicated (e.g., communicated without operator input) responsive to the vehicle segments 200, 202 mechanically and/or fluidly coupling with each other. In one embodiment, the vehicle 102C also may apply the brakes of the vehicle 102C. For example, the independent brakes of the vehicle 102C may be applied and/or the pressure of the air brakes in the vehicle 102C may be reduced by a designated amount (e.g., 10 pounds per square inch or another amount) prior to, during, and/or subsequent to communication of the reconnect command signal.

The operating mode of the remote vehicle 102C may be switched from a suspend mode (e.g., used to suspend the DP mode, as described above) to the DP mode. This switch can occur by the operator providing input to a controller of the vehicle 102C and/or automatically responsive to the vehicle segments 200, 200 mechanically and/or fluidly coupling with each other. A test of the brake pipe 108 in the vehicle system 100 can be tested, such as by measuring the pressure and/or rate of fluid flow in the brake pipe 108. If the pressure and/or rate of flow are sufficiently large (e.g., greater than one or more non-zero, designated thresholds), then the propulsion-generating vehicles 102 in the previous vehicle segments 200, 202 can return to the DP mode such that the lead vehicle 102 can control operations of the vehicles 102.

Operating the vehicles 102 in this manner to suspend the DP mode, mechanically and fluidly decouple the vehicle system 100 into two or more separate vehicle segments 200, 202, move the vehicle segments 200, 202 separately from each other, mechanically and fluidly re-connecting the vehicle segments 200, 202, and then ending the suspension of the DP mode can be performed without application of a brake penalty. For example, separating the vehicle system 100 in another manner (e.g., without placing the vehicle system into a safe state, without suspending DP mode, without sending one or more of the signals described herein, without performing a brake test, or the like) can result in the brakes of the vehicle system 100 (e.g., the air brakes) being automatically applied and prevented from being removed for at least a designated time period. In environments where it can take a significant period of time to build up fluid pressure in the brake line 108 following a penalty application of the brakes (e.g., in extremely cold environments), avoiding the penalty application of the brakes can allow for the vehicle system 100 to be split up into vehicle segments that can be separately moved and then re-combined into the vehicle system 100 in a relatively short time frame.

In an aspect, vehicle systems may be configured for an automatic penalty brake application (e.g., the brakes of the vehicle system are automatically applied) responsive to one or more designated events. A designated event is one which the vehicle system is designed/configured to respond to, based on a mechanical configuration of the vehicle system, the vehicle system being configured to receive information about the event (e.g., from sensors) and automatically apply criteria to the information (e.g., with a processor) to assess if the event has occurred, or the like.

The penalty brake application of the brakes may differ from other types of brake applications. In one embodiment, the penalty brake application differs from other types of brake applications based on the amount of braking effort applied. For example, an operator commanded brake application may involve the operator of the vehicle system manually controlling how much braking effort is provided by one or more of the vehicles and/or the entire vehicle system. As the operator commanded brake application increases, the brakes of the vehicles and/or the entire vehicle system apply more braking effort, such as by decreasing pressure in the brake system of the vehicle system by a corresponding amount. Conversely, as the operator commanded brake application decreases, the brakes of the vehicles and/or the entire vehicle system apply less braking effort, such as by decreasing pressure in the brake system of the vehicle system by a corresponding lesser amount. The rate at which the braking effort is applied (e.g., the rate at which pressure in the brake pipe decreases) during an operator commanded brake application may be a fixed or designated rate, which can be referred to as a service rate. This service rate also may be used for a penalty brake application to control the rate at which the brake pipe pressure decreases during the penalty brake application.

Additionally, the penalty brake application also may differ from an emergency brake application. The emergency brake application also may be initiated by the operator and/or may be automatically initiated based on failure of equipment of the brake pipe. The automatic emergency brake application reduces the pressure in the brake pipe at a faster rate than the penalty brake application or the operator commanded brake application (e.g., faster than the service rate). The emergency brake application may involve all or substantially all of the pressure in the brake pipe being exhausted out of the vehicle system. For example, the fluid pressure in the brake pipe may be reduced to zero or to a value that is substantially small to avoid reducing the brake effort applied by the brake system. In contrast, the operator commanded brake application and/or the penalty brake application may be limited to reducing the brake pipe pressure to a designated, non-zero level that prevents all of the braking effort from being applied.

The penalty brake application may be automatically (e.g., without operator intervention) initiated by safety equipment of the vehicle system in response to one or more designated events. Like the operator commanded brake application, the brake pipe pressure in the penalty brake application can be reduced at the same service rate. But, the brake system may continue exhausting the fluid pressure in the brake pipe until the pressure is zero or to a value that is substantially small to avoid reducing the brake effort applied by the brake system.

The penalty brake application also may differ from the operator commanded brake application and/or the emergency brake application based on the amount of time needed to recharge the brake system (e.g., how long it takes to increase the fluid pressure in the brake system following the brake application in order to remove the braking effort applied by the brake system). For example, after an operator commanded brake application, enough fluid must be pumped into the brake pipe to raise the pressure in the brake pipe up to at least a designated, non-zero threshold (e.g., 90 psi or another value). Additionally, one or more, or all, of the vehicles may have a reservoir of fluid used to apply the brake that is to be recharged. Recovery from a penalty brake application may take longer than an operator commanded brake application because the fluid pressure in all of the brake pipe and reservoirs may need to be increased to at least the designated level, instead of increasing the fluid pressure in the brake pipe only or increasing the fluid pressure from a larger value (which may occur following an operator commanded brake application). An emergency brake application may take even longer because in addition to recharging the brake pipe and the reservoirs, one or more, or all, of the vehicles in the vehicle system may have an additional emergency reservoir of fluid for the brake system that may need to be recharged following the brake application.

One or more additional safety features may be provided. For example, the separation of the vehicle system 100 into separate vehicle segments 200, 202 may be prohibited or only allowed within certain designated geographic areas. The communication device 314 or a locating device (e.g., a global positioning system receiver or other device) can monitor locations of the vehicle system 100. If the operator(s) of the vehicle system 100 attempt to break up the vehicle system 100 into the vehicle segments 200, 202 in a prohibited location, then a command system 320 (described below) may prevent the vehicle system 100 from operating to separate into the vehicle segments 200, 202.

In another aspect, the communication devices 314 onboard the vehicles 300 may establish communication links during operation in the cooperative mode. For example, the communication devices 314 may communicate linking signals that establish a "handshake" between the communication devices 314. The communication devices 314 can then communicate with each other in the cooperative mode. In one embodiment, when the cooperative mode is suspended and/or during separate movements of the vehicle segments, the communication devices 314 may maintain these communication links. For example, the communication devices 314 may continue to periodically or erratically communicate with each other to ensure that the communication devices 314 are able to continue to communicate should the suspension of the cooperative mode be lifted. If the communication devices 314 are unable to communicate, then, in one embodiment, the movement of the separate vehicle segments may be suspended until the communication devices 314 are able to communicate.

In another aspect, the controllers 300 may limit how fast the separate vehicle segments travel when the segments travel separately from each other. The controllers 300 may not permit the corresponding vehicle segments to travel faster than a designated speed limit that is slower than the speed limit of the route being traveled and/or slower than a speed limit that the vehicle system 100 obeys. This speed limit may be slower than the speed that the separate vehicle segments would be able to achieve if the speed limit were not applied.

In another aspect, the remote vehicle segments may continue to respond to certain command signals remotely communicated from the leading vehicle in another vehicle segment. For example, the remote propulsion-generating vehicles in the remote vehicle segment may continue to respond to operational command signals communicated from the leading propulsion-generating vehicle in the leading vehicle segment while the leading and remote vehicle segments are separated from each other, even though the cooperative mode has been suspended. The types of operational command signals to which the remote vehicles may continue to respond to may include those commands that slow or stop movement of the remote vehicles, and the remote vehicles may ignore those commands that speed up or initiate movement of the remote vehicles. For example, the remote vehicles may respond to commands to initiate applications of brakes, but may not respond to commands to increase a throttle setting. These commands may be communicated wirelessly or over one or more wired connections, may be received from the leading vehicle or another remote vehicle, may be communicated by a reduction in fluid pressure in the brake line, or the like.

Figure 3:
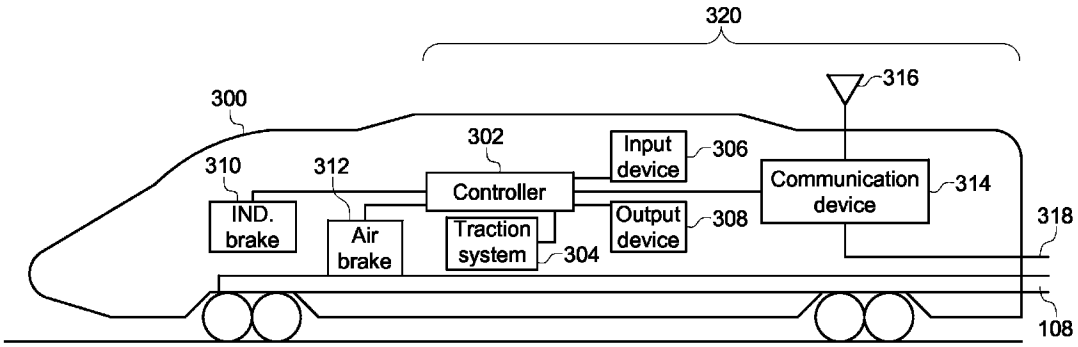
FIG. 3 schematically illustrates a propulsion-generating vehicle according to one embodiment.

FIG. 3 schematically illustrates a propulsion-generating vehicle 300 according to one embodiment. The vehicle 300 may represent one or more of the propulsion-generating vehicles 102 shown in FIG. 1. The vehicle 300 includes the command system 320 that operates to control operations of the vehicle 300 and optionally to remotely control operations of other vehicles 300 (e.g., the remote vehicles in the same vehicle system). While the command system 320 is shown as being disposed onboard a single vehicle, optionally, the command system 320 may extend across multiple vehicles in the vehicle system. For example, the command system 320 may include controllers 302, input devices 306, output devices 308, and/or communication devices 314 disposed onboard two or more vehicles 300 in the same vehicle system.

The controller 302 represents hardware circuits or circuitry that includes and/or is connected with one or more computer processors, such as one or more computer microprocessors, gate arrays, or the like. The controller 302 is used to autonomously and/or manually control operations of the vehicle 300 and/or other vehicles in the vehicle system 100 (e.g., in DP mode). Optionally, the controller 302 may receive command signals from another vehicle and control operations of the vehicle 300 based on the received command signals. The controller 302 can be operably coupled with one or more traction systems 304, such as traction motors, that generate tractive effort to propel the vehicle 300 in response to command signals received from the controller 302. For example, the controller 302 may be connected with the traction system 304 by one or more wired and/or wireless communication paths.

One or more input devices 306 of the vehicle 300 are controlled by an operator to receive information provided by the operator. The input device 306 can include one or more levers, pedals, buttons, switches, touchscreen, keyboards, styluses, or the like. The operator can control the input device 306 to change throttle settings, brake settings, or the like, of the vehicle 300, another vehicle, and/or the vehicle system 100.

One or more output devices 308 of the vehicle 300 present information to the operator of the vehicle 300. The output device 308 can include a monitor, television, touchscreen, or other device. The output device 308 can report the operational mode of the vehicle 300 and/or vehicle system 100 (e.g., DP mode, suspend mode, or another mode), operational settings of the vehicle 300, or the like. The output device 308 may present the pressure and/or rate of fluid flow in the brake pipe 108 (e.g., based on data obtained from one or more sensors of the brake pipe 108). The output device 308 can inform the operator as to whether the vehicle system 100 is separated into the vehicle segments 200, 202.

A first brake system 310 ("Ind. Brake" in FIG. 3) can be used by the controller 302 to slow or stop movement of the vehicle 300. The first brake system 310 may be activated or deactivated based on receipt of command signals from the controller 302 directing the first brake system 310 to activate or deactivate. Additionally or alternatively, a second brake system 312 ("Air Brake" in FIG. 3) may be activated by the controller 302 to slow or stop movement of the vehicle 300. The second brake system 312 may operate based on fluid pressure in the brake pipe 108, as described above. The controller 302 can control one or more valves or the like that can vent the fluid out of the brake pipe 108 to reduce the pressure in the brake pipe 108. If the pressure is reduced by a sufficient amount, then the second brake system 312 is activated. The controller 302 can close the valves to allow the pressure of the fluid to build up in the brake pipe 108, which can cause the second brake system 312 to be deactivated.

A communication device 314 includes hardware circuits or circuitry that include and/or are connected with one or more computer processors (e.g., microprocessors, gate arrays, or the like), transceiving equipment, and the like. The communication device 314 controls communication between the vehicle 300 and one or more off-board systems, such as another vehicle, an off-board location, or the like. The communication device 314 can be operably coupled with an antenna 316 for wirelessly communicating with other vehicles, off-board locations, or other systems. Optionally, the communication device 314 can be operably coupled with one or more wired connections 318, such as one or more cables, buses, wires, or the like (e.g., a multiple unit cable, a trainline, etc.), for communication with another vehicle or system in the same vehicle segment 200, 200 as the vehicle 300 and/or in the same vehicle system 100. The communication device 314 can communicate (e.g., transmit, broadcast, and/or receive) various signals with other vehicles, such as command signals, suspend command signals, reconnect command signals, or the like.

Figure 5:
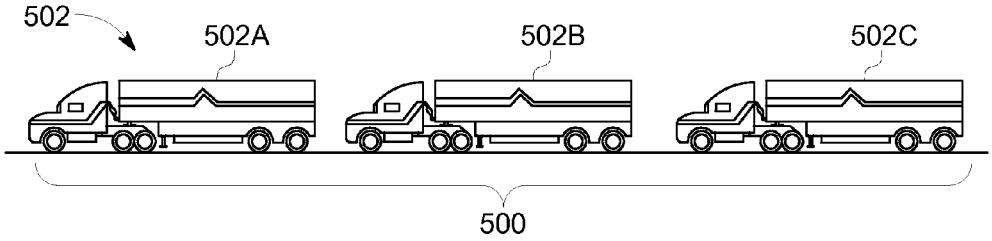
FIG. 5 illustrates another vehicle system according to another embodiment.

FIG. 5 illustrates another vehicle system 500 according to another embodiment. The vehicle system 500 is formed from plural propulsion-generating vehicles 502 (e.g., vehicles 502A-C) that can travel together in a cooperative mode without the vehicles 502 being mechanically coupled with each other. For example, a lead vehicle 502A may travel along a route with remote vehicles 502B, 502C traveling behind without the vehicles 502 being mechanically coupled by couplers. In the illustrated example, the vehicles 502 are tractor trailers, but alternatively can be automobiles, marine vessels, aircrafts (e.g., airplanes, drones, etc.), off-highway vehicles (e.g., vehicles that are not designed or are not permitted to travel on public roadways), or other vehicles. The vehicles 502 may be referred to as being logically coupled with each other in the vehicle system 500, as opposed to being mechanically and/or fluidly coupled with each other as described above in connection with the vehicle system 100.

The lead vehicle 502A can remotely control operations of the remote vehicles 502B, 502C. For example, the lead vehicle 502A can wirelessly communicate command signals to the vehicles 502B, 502C to direct throttle settings, speeds, brake settings, turns, or the like, of the remote vehicles 502B, 502C. Optionally, the operations of the vehicles 502 can be coordinated with each other by the lead vehicle 502A having one or more sensors (e.g., cameras, accelerometers, speed sensor, proximity sensor, radar sensor, or the like) that communicate data representative of operations of the lead vehicle 502A to the remote vehicles 502B, 502C. Based on this communicated data, the remote vehicles 502B, 502C may change operational settings of the remote vehicles 502B, 502C. For example, control of the remote vehicle 502B and/or 502C may be automatically controlled based on the data received from the lead vehicle 502A. As another example, control of the remote vehicle 502B and/or 502C may be manually controlled by onboard operators that control the vehicles 502B, 502C based on the data received from the lead vehicle 502A.

The vehicles 502 may coordinate movements to reduce drag forces imparted on the vehicles 502. For example, the remote vehicle 502B may follow relatively close to the lead vehicle 502A, the remote vehicle 502C may follow relatively close to the remote vehicle 502B, and so on (e.g., within ten meters of each other, within five meters, within twenty meters, or another distance), so that drag on the vehicles 502B, 502C is reduced relative to the vehicles 502B, 502C following by another distance. The vehicles 502B, 502C can monitor movements and/or upcoming hazards based on the data received from the lead vehicle 502A so that safe travel of the vehicle system 500 is not compromised. Reducing the drag imparted on the vehicles 502 can reduce fuel consumed by the vehicles 502, emissions generated by the vehicles 502, times required to complete a trip, or the like, relative to the vehicles 502 not coordinating movements with each other.

Figure 6:
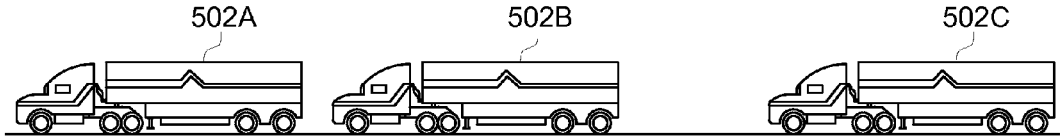
FIG. 6 illustrates the vehicle system shown in FIG. 5 separated into vehicle segments according to one embodiment.

FIG. 6 illustrates the vehicle system 500 shown in FIG. 5 separated into vehicle segments according to one embodiment. Similar to the vehicle system 100 shown in FIG. 1, the vehicle system 500 can be separated into different vehicle segments. In the illustrated embodiment, the vehicles 502 can separate into different vehicle segments, with each vehicle 502 being a different vehicle segment. Alternatively, two or more of the vehicles 502 (e.g., the vehicles 502A, 502B) can remain logically coupled with each other in one vehicle segment while one or more other vehicles 502 (e.g., the vehicle 502C) is in another, separate vehicle segment.

The vehicle system 500 may separate into different vehicle segments in a manner similar to the vehicle system 100. For example, the vehicle system 500 may enter a safe state by slowing or stopping the coordinated movement of the vehicles 502. A suspend command signal may be communicated between the vehicles 502 to suspend the coordination mode of operations. The vehicles 502 may apply brakes and then be logically de-coupled from each other. The vehicles 502 may then separately move independent of each other. To logically re-couple the vehicles 502, the vehicles 502 may communicate a reconnect command signal, test the brakes of the vehicles 502, and then be logically re-coupled with each other. The vehicles 502 may then coordinate operations with each other and travel on the route as the vehicle system 500.

Figure 4:
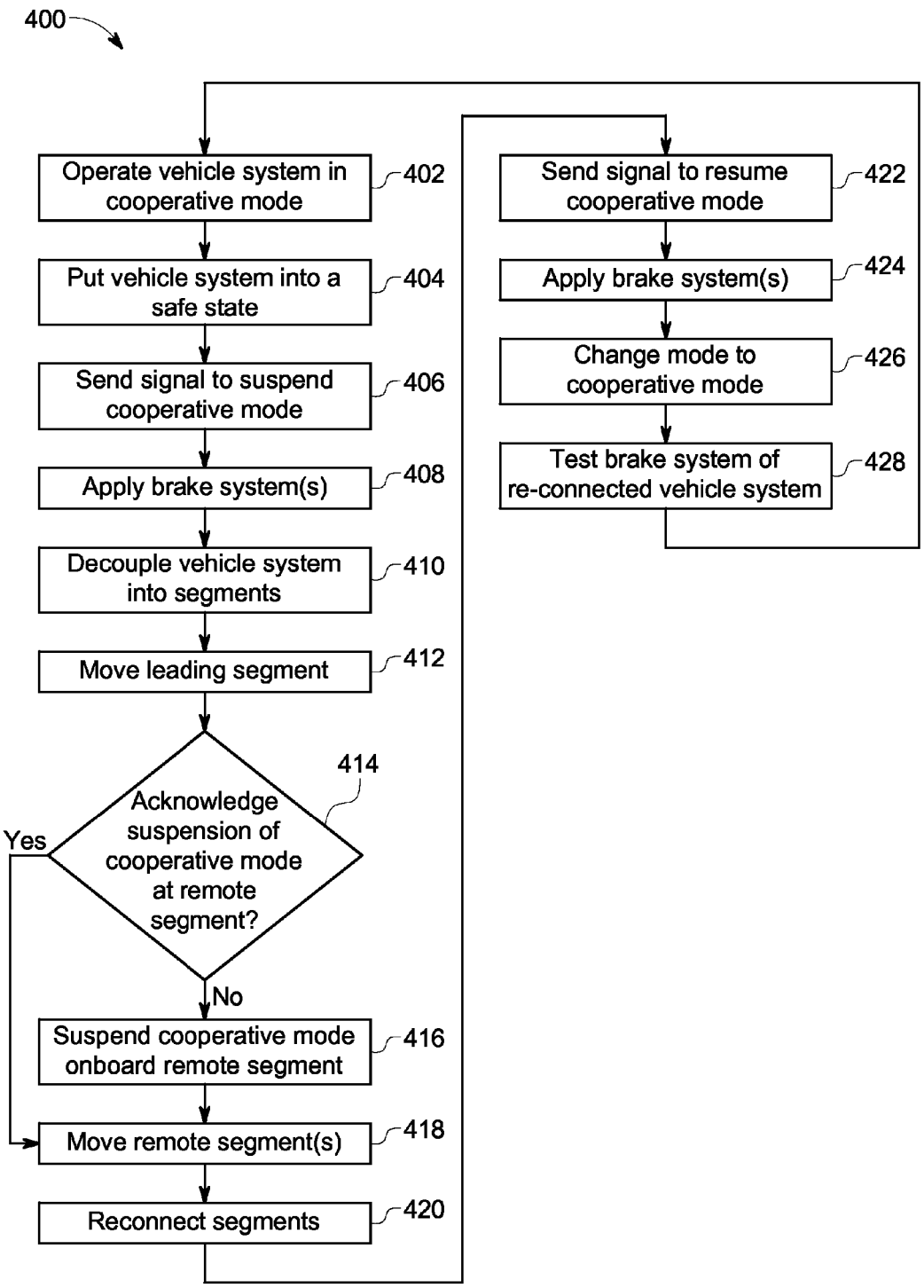
FIG. 4 illustrates a flowchart of a method for decoupling a vehicle system according to one embodiment.

FIG. 4 illustrates a flowchart of a method 400 for decoupling a vehicle system according to one embodiment. The method 400 may be used to mechanically, fluidly, and/or logically separate the vehicle system 100 shown in FIG. 1 into two or more vehicle segments 200, 200 (shown in FIG. 2) that can move separate from each other.

At 402, a vehicle system having two or more propulsion-generating vehicles operates in a cooperative mode. With respect to the vehicle system 100, the propulsion-generating vehicles 102 (shown in FIG. 1) may be operating in the DP mode, with a lead vehicle 102 remotely controlling operations of one or more remote vehicles 102. Alternatively, the vehicle system may include two or more vehicles that are not mechanically coupled with each other, but that operate in a cooperative mode by communicating operational data between the vehicles and controlling movement of the vehicles based on the operational data that is communicated.

At 404, the vehicle system is placed into a safe state. The safe state can include a stationary vehicle system or the vehicle system slowing below a lower speed limit. For example, the vehicle system can be placed into the safe state by stopping movement of the vehicle system or slowing the vehicle system below the lower speed limit. Optionally, the vehicle system may enter the safe state by stopping or slowing movement on a portion of the route that has a grade that is less than a designated grade (e.g., the angle of inclination of the portion of the route is less than a lower angle threshold), that has a curvature that is larger than a designated radius or circumference thresholds, that has less than a designated number of other vehicles or vehicle systems traveling thereon, or the like.

At 406, a signal is communicated between the vehicles to suspend the cooperative mode of travel of the vehicle system. For example, a suspend command signal may be sent from a lead vehicle to one or more remote vehicles in the vehicle system. This command signal may direct the remote vehicles to stop operating according to command signals from the lead vehicle that attempt to control movement operations of the remote vehicles. In one aspect, this suspend command signal may suspend DP operations of the vehicle system. In another aspect, this suspend command signal may otherwise prevent the remote vehicles from being remotely controlled by the lead vehicle.

At 408, one or more brake systems of the vehicles are applied. For example, the vehicles may apply independent brakes of brake systems that are onboard the vehicles. With respect to rail vehicles, this could involve applying independent brakes of locomotives. With respect to other types of vehicles, this could involve applying brakes disposed onboard the different vehicles. Optionally, a brake system for the entire vehicle system may be applied. With respect to rail vehicles, this brake system could be an air brake system. This can be useful as an added safety feature to prevent unauthorized movement of any vehicles. This safety feature additionally may prevent a penalty application of one or more brake systems of the vehicle system.

At 410, the vehicle system is decoupled into two or more segments. For example, two or more groups of vehicles may be mechanically decoupled from each other such that the groups of vehicles are separated into vehicle segments and are no longer joined together by couplers or other mechanical bodies. If the vehicles also are fluidly coupled with each other (such as by an air brake system or other fluid system), then the fluid coupling between the groups of vehicles may be fluidly decoupled from each other (e.g., to form the brake line segments described above). If the vehicles are logically coupled, but not mechanically coupled, then the decoupling of the vehicle system may occur when the cooperative mode of operation of the vehicle system is suspended.

At 412, a leading segment of the vehicle segments formed by decoupling the vehicle system optionally may be moved. For example, the segment of the vehicle system that includes the leading vehicle that previously controlled operations of the remote vehicles may be operated to move the segment relative to one or more other vehicles or other vehicle segments. Optionally, the leading segment of the vehicle segments is not moved or one or more other vehicle segments are moved with the leading segment. The leading segment may be moved to perform one or more operations with the leading segment, such as loading cargo into the leading segment, unloading cargo from the leading segment, performing maintenance on the leading segment, repairing one or more components or vehicles of the leading segment, inspecting the vehicle segment, adding vehicle(s) to the leading segment, removing vehicle(s) from the leading segment, or the like.

At 414, a determination is made as to whether the cooperative mode of operation has been suspended at the remote vehicles in one or more of the vehicle segments other than the leading segment. This determination can be completed by an operator onboard the remote vehicles confirming that the cooperative mode has been suspended on the remote vehicles. This confirmation may occur by the operator(s) actuating input devices onboard the remote vehicles, by the operator(s) communicating with one or more other operators (e.g., using a radio, phone, or other manner of communication), by the controller(s) onboard the remote vehicles automatically sending a signal that confirms the suspension of the cooperative mode, or the like.

If a confirmation has been received (e.g., at the leading vehicle or another location) that the cooperative mode has been suspended at the remote vehicles, then the segment(s) that include the remote vehicles can begin moving independent of the leading segment and/or the other remote segments. As a result, flow of the method 400 can proceed to 418. Otherwise, it may be unsafe to move the remote vehicle segments as the remote propulsion-generating vehicles in these segments may still be operating in the cooperative mode. For example, the remote vehicles may continue to be remotely controlled based on signals issued by the leading vehicle. As a result, flow of the method 400 proceeds to 416.

At 416, the cooperative mode is suspended at the remote vehicles. For example, an operator may move onboard the remote vehicles on which a confirmation of the suspension of the cooperative mode was not received and suspend the cooperative mode onboard the remote vehicles. The operator may do so by actuating input devices onboard the remote vehicles, directing or causing the leading vehicle to send another suspend command signal, or the like.

At 418, the remote segments optionally may be moved relative to each other and/or the leading segment. For example, the remote segments may be moved independent of each other and the leading segment. The remote segments may be controlled from onboard the remote vehicles in the respective remote segments. Optionally, one or more of the remote vehicles may be communicatively coupled with an off-board controller that sends command signals to remotely control movements of the remote segments. The remote segment(s) may be moved to perform one or more operations with the remote segment(s), such as loading cargo into the remote segment(s), unloading cargo from the remote segment (s), performing maintenance on the remote segment(s), repairing one or more components or vehicles of the remote segment(s), inspecting the remote segment(s), adding vehicle (s) to the remote segment(s), removing vehicle(s) from the remote segment(s), or the like.

At 420, the segments optionally may be re-connected with each other. If the segments are to be mechanically linked together, one or more couplers or other mechanical bodies may be connected to the end vehicles in the different segments to mechanically couple the segments into a larger vehicle system. If the segments are to be fluidly coupled, the separate fluid segments (e.g., the brake line segments) may be fluidly coupled with each other, as described above. If the segments are to be logically connected with each other without mechanical or fluid coupling, then the vehicles or vehicle segments may be positioned relatively close to each other (e.g., within a designated distance that is shorter than the communication over which the vehicles are able to wirelessly communicate with each other).

At 422, a reconnect command signal is communicated to resume the cooperative mode. For example, the leading vehicle can send the reconnect command signal to the remote vehicles. This signal can direct the remote vehicles to resume operating in the cooperative mode, such as by operating according to future command signals issued by the leading vehicle.

At 424, one or more brake systems of the vehicles are applied. For example, the vehicles may apply independent brakes of brake systems that are onboard the vehicles. Optionally, a brake system for the entire vehicle system may be applied. At 426, the operating mode onboard the vehicles is changed to the cooperative mode. For example, even though the reconnect command signal is previously communicated to the propulsion-generating vehicles, these vehicles may not switch to the cooperative mode until the brake systems are applied. This can be useful as an added safety feature to prevent unauthorized movement of any vehicles. This safety feature additionally may prevent a penalty application of one or more brake systems of the vehicle system.

At 428, one or more brake systems of the re-connected vehicle system are tested. For example, if the vehicle system has a brake system that is separate from the independent brakes of the propulsion-generating vehicles, then this brake system of the vehicle system can be tested. This test can include measuring, sensing, testing, or the like, a fluid pressure in a brake line, a rate of fluid flow in the brake line, a braking force applied by the brake system, etc.

At this point, the vehicle system may resume to operating in the cooperative mode. For example, the vehicle system can resume moving along the route, with the remote propulsion-generating vehicles being controlled by the leading propulsion-generating vehicle.

In one embodiment, a method (e.g., for decoupling a vehicle system) includes, onboard a vehicle system comprising plural propulsion-generating vehicles coupled together and operating in a cooperative mode, communicating a suspend command signal between two or more of the propulsion-generating vehicles to suspend operations of the propulsion-generating vehicles in the cooperative mode, decoupling the propulsion-generating vehicles in the vehicle system into plural separate vehicle segments, moving one or more of the vehicle segments separately from one or more other vehicle segments, reconnecting the vehicle segments to form the vehicle system, and communicating a reconnect command signal between the vehicle segments to resume operations of the propulsion-generating vehicles in the cooperative mode. The propulsion-generating vehicles are decoupled from each other, moved separately from each other in the vehicle segments, and reconnected in the vehicle segments to form the vehicle system without incurring a penalty brake application of the vehicle system.

In one aspect, the method also includes the vehicle system initiating the penalty brake application responsive to the occurrence of one or more designated events. The penalty brake application comprises an automatic activation of one or more brake systems of the vehicle system to at least one of slow the vehicle system, bring the vehicle system to a stop, or prevent the vehicle system from moving.

In one aspect, the propulsion-generating vehicles in the vehicle system include a leading propulsion-generating vehicle and one or more remote propulsion-generating vehicles. The method also can include operating the vehicle system in the cooperative mode by remotely controlling movements of the remote propulsion-generating vehicles from the leading propulsion-generating vehicle.

In one aspect, the method also includes confirming suspension of the cooperative mode at the remote propulsion-generating vehicles prior to moving the one or more of the vehicle segments that includes the one or more remote propulsion-generating vehicles.

In one aspect, the method also includes operating the vehicle system to a safe state prior to communicating the suspend command signal.

In one aspect, the method also includes applying one or more brake systems of the vehicle system prior to decoupling the propulsion-generating vehicles into the vehicle segments.

In one aspect, the vehicle system includes the propulsion-generating vehicles being both mechanically and fluidly coupled with each other. Decoupling the propulsion-generating vehicles into the vehicle segments can include both mechanically decoupling and fluidly decoupling the propulsion-generating vehicles from each other.

In one aspect, the vehicle system includes the propulsion-generating vehicles being logically coupled with each other without being mechanically coupled with each other, and decoupling the propulsion-generating vehicles into the vehicle segments can include logically decoupling the propulsion-generating vehicles from each other such that the propulsion-generating vehicles can separately move from each other.

In another embodiment, a system (e.g., a command system) includes a controller (e.g., a first controller) configured to be disposed onboard a leading propulsion-generating vehicle of a vehicle system that includes one or more remote propulsion-generating vehicles coupled together and operating in a cooperative mode. The controller is configured to communicate a suspend command signal to the one or more remote propulsion-generating vehicles to suspend operations of the leading and remote propulsion-generating vehicles in the cooperative mode. The leading and remote propulsion-generating vehicles in the vehicle system are decoupled from each other into plural separate vehicle segments responsive to communication of the suspend command signal. The controller also is configured, responsive to the vehicle segments being reconnected to form the vehicle system after the vehicle segments are moved separately from one another, to communicate a reconnect command signal to the one or more remote propulsion-generating vehicles to resume operations of the propulsion-generating vehicles in the cooperative mode. The first controller is configured to avoid a penalty brake application of the vehicle system responsive to the propulsion-generative vehicles being decoupled from each other, moving separately from each other in the vehicle segments, or being reconnected with each other in the vehicle segments to form the vehicle system.

In one aspect, the system also includes one or more additional controllers (e.g., second controllers) configured to be disposed onboard the one or more remote propulsion-generating vehicles. At least one of the first controller or the one or more second controllers also is configured to move one or more of the vehicle segments separately from one or more other vehicle segments. The first controller also is configured to communicate a reconnect command signal to the one or more second controllers to resume operations of the propulsion-generating vehicles in the cooperative mode responsive to the vehicle segments being reconnected to form the vehicle system. The first controller and the one or more second controllers are configured to avoid a penalty brake application of the vehicle system responsive to the propulsion-generative vehicles being decoupled from each other, moving separately from each other in the vehicle segments, or being reconnected with each other in the vehicle segments to form the vehicle system.

In one aspect, the one or more second controllers are configured to receive a confirmation of suspension of the cooperative mode at the remote propulsion-generating vehicles prior to moving the one or more of the vehicle segments that includes the one or more remote propulsion-generating vehicles.

In one aspect, the vehicle system includes the propulsion-generating vehicles being both mechanically and fluidly coupled with each other. The first controller and the one or more second controllers are configured to separately control movements of the vehicle segments responsive to both mechanically decoupling and fluidly decoupling the propulsion-generating vehicles from each other.

In one aspect, the vehicle system includes the propulsion-generating vehicles being logically coupled with each other without being mechanically coupled with each other. The first controller and the one or more second controllers can be configured to decouple the propulsion-generating vehicles into the vehicle segments by logically decoupling the propulsion-generating vehicles from each other such that the propulsion-generating vehicles can separately move from each other.

In one aspect, the first controller is configured to operate the vehicle system in the cooperative mode by remotely controlling movements of the remote propulsion-generating vehicles from the leading propulsion-generating vehicle.

In one aspect, the first controller is configured to control operations of the vehicle system and to control the vehicle system to a safe state prior to communicating the suspend command signal.

In one aspect, the first controller is configured to apply one or more brake systems of the vehicle system prior to the propulsion-generating vehicles from being decoupled into the vehicle segments.

In another embodiment, a method (e.g., for decoupling a vehicle system) includes controlling movement of a remote propulsion-generating vehicle in a vehicle system that includes at least a leading propulsion-generating vehicle coupled with the remote propulsion-generating vehicle. The movement of the remote propulsion-generating vehicle is controlled based on operational command signals received from the leading propulsion-generating vehicle. The method also can include suspending control of the movements of the remote propulsion-generating vehicle based on the operational command signals responsive to receiving a suspend command signal at the remote propulsion-generating vehicle and, responsive to confirming suspension of control of the movements of the remote propulsion-generating vehicle based on the operational command signals, separating the vehicle system into a leading vehicle segment that includes the leading propulsion-generating vehicle and a remote vehicle segment that includes the remote propulsion-generating vehicle. The method may further include moving the remote vehicle segment separately from movement of the leading vehicle segment, connecting the remote vehicle segment with the leading vehicle segment to form the vehicle system, and resuming control of the movement of the remote propulsion-generating vehicle based on the operational command signals received from the leading propulsion-generating vehicle.

In one aspect, separating the vehicle system, moving the remote vehicle segment, connecting the remote vehicle segment with the leading vehicle segment, and resuming control of the movement of the remote propulsion-generating vehicle are performed without initiation of a penalty brake application.

In one aspect, the method also includes operating the vehicle system to a safe state prior to suspending control of the movements of the remote propulsion-generating vehicle.

In one aspect, the method also includes applying one or more brake systems of the vehicle system prior to separating the vehicle system into the lead vehicle segment and the remote vehicle segment.

In one aspect, the vehicle system includes the lead and remote propulsion-generating vehicles being both mechanically and fluidly coupled with each other directly, by another propulsion-generating vehicle, or by one or more non-propulsion-generating vehicles. Separating the vehicle system into the lead and remote vehicle segments can include both mechanically decoupling and fluidly decoupling the lead and remote propulsion-generating vehicles from each other.

In one aspect, the vehicle system includes the lead and remote propulsion-generating vehicles being logically coupled with each other without being mechanically coupled with each other. Separating the vehicle system into the lead and remote vehicle segments can include logically decoupling the lead and remote propulsion-generating vehicles from each other such that the lead and remote propulsion-generating vehicles can separately move from each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

As used herein, a structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

What is claimed is:

1. A method comprising:

onboard a vehicle system comprising plural propulsion-generating vehicles coupled together and operating in a cooperative mode, communicating a suspend command signal between two or more of the propulsion-generating vehicles to suspend operations of the propulsion-generating vehicles in the cooperative mode;

decoupling the propulsion-generating vehicles in the vehicle system into plural separate vehicle segments;

moving one or more of the vehicle segments separately from one or more other vehicle segments;

reconnecting the vehicle segments to form the vehicle system; and communicating a reconnect command signal between the vehicle segments to resume operations of the propulsion-generating vehicles in the cooperative mode, wherein the propulsion-generating vehicles are decoupled from each other, moved separately from each other in the vehicle segments, and reconnected in the vehicle segments to form the vehicle system without incurring a penalty brake application of the vehicle system.

2. The method of claim 1, further comprising the vehicle system initiating the penalty brake application responsive to the occurrence of one or more designated events, wherein the penalty brake application comprises an automatic activation of one or more brake systems of the vehicle system to at least one of slow the vehicle system, bring the vehicle system to a stop, or prevent the vehicle system from moving.

3. The method of claim 1, wherein the propulsion-generating vehicles in the vehicle system include a leading propulsion-generating vehicle and one or more remote propulsion-generating vehicles, and further comprising operating the vehicle system in the cooperative mode by remotely controlling movements of the remote propulsion-generating vehicles from the leading propulsion-generating vehicle.

4. The method of claim 3, further comprising confirming suspension of the cooperative mode at the remote propulsion-generating vehicles prior to moving the one or more of the vehicle segments that includes the one or more remote propulsion-generating vehicles.

5. The method of claim 1, further comprising operating the vehicle system to a safe state prior to communicating the suspend command signal.

6. The method of claim 1, further comprising applying one or more brake systems of the vehicle system prior to decoupling the propulsion-generating vehicles into the vehicle segments.

7. The method of claim 1, wherein the vehicle system includes the propulsion-generating vehicles being both mechanically and fluidly coupled with each other, and wherein decoupling the propulsion-generating vehicles into the vehicle segments includes both mechanically decoupling and fluidly decoupling the propulsion-generating vehicles from each other.

8. The method of claim 1, wherein the vehicle system includes the propulsion-generating vehicles being logically coupled with each other without being mechanically coupled with each other, and wherein decoupling the propulsion-generating vehicles into the vehicle segments includes logically decoupling the propulsion-generating vehicles from each other such that the propulsion-generating vehicles can separately move from each other.

9. A system comprising:

a first controller configured to be disposed onboard a leading propulsion-generating vehicle of a vehicle system that includes one or more remote propulsion-generating vehicles coupled together and operating in a cooperative mode, the first controller configured to communicate a suspend command signal to the one or more remote propulsion-generating vehicles to suspend operations of the leading and remote propulsion-generating vehicles in the cooperative mode, wherein the leading and remote propulsion-generating vehicles in the vehicle system are decoupled from each other into plural separate vehicle segments responsive to communication of the suspend command signal;

wherein the first controller also is configured, responsive to the vehicle segments being reconnected to form the vehicle system after the vehicle segments are moved separately from one another, to communicate a reconnect command signal to the one or more remote propulsion-generating vehicles to resume operations of the propulsion-generating vehicles in the cooperative mode, wherein the first controller is configured to avoid a penalty brake application of the vehicle system responsive to the propulsion-generative vehicles being decoupled from each other, moving separately from each other in the vehicle segments, or being reconnected with each other in the vehicle segments to form the vehicle system.

10. The system of claim 9, further comprising one or more second controllers configured to be disposed onboard the one or more remote propulsion-generating vehicles, wherein at least one of the first controller or the one or more second controllers also is configured to move one or more of the vehicle segments separately from one or more other vehicle segments, wherein the first controller also is configured to communicate a reconnect command signal to the one or more second controllers to resume operations of the propulsion-generating vehicles in the cooperative mode responsive to the vehicle segments being reconnected to form the vehicle system, wherein the first controller and the one or more second controllers are configured to avoid a penalty brake application of the vehicle system responsive to the propulsion-generative vehicles being decoupled from each other, moving separately from each other in the vehicle segments, or being reconnected with each other in the vehicle segments to form the vehicle system.

11. The system of claim 10, wherein the one or more second controllers are configured to receive a confirmation of suspension of the cooperative mode at the remote propulsion-generating vehicles prior to moving the one or more of the vehicle segments that includes the one or more remote propulsion-generating vehicles.

12. The system of claim 10, wherein the vehicle system includes the propulsion-generating vehicles being both mechanically and fluidly coupled with each other, and wherein the first controller and the one or more second controllers are configured to separately control movements of the vehicle segments responsive to both mechanically decoupling and fluidly decoupling the propulsion-generating vehicles from each other.

13. The system of claim 10, wherein the vehicle system includes the propulsion-generating vehicles being logically coupled with each other without being mechanically coupled with each other, and wherein the first controller and the one or more second controllers are configured to decouple the propulsion-generating vehicles into the vehicle segments by logically decoupling the propulsion-generating vehicles from each other such that the propulsion-generating vehicles can separately move from each other.

14. The system of claim 9, wherein the first controller is configured to operate the vehicle system in the cooperative mode by remotely controlling movements of the remote propulsion-generating vehicles from the leading propulsion-generating vehicle.

15. The system of claim 9, wherein the first controller is configured to control operations of the vehicle system and to control the vehicle system to a safe state prior to communicating the suspend command signal.

16. The system of claim 9, wherein the first controller is configured to apply one or more brake systems of the vehicle system prior to the propulsion-generating vehicles from being decoupled into the vehicle segments.

17. A method comprising:

controlling movement of a remote propulsion-generating vehicle in a vehicle system that includes at least a leading propulsion-generating vehicle coupled with the remote propulsion-generating vehicle, the movement of the remote propulsion-generating vehicle controlled based on operational command signals received from the leading propulsion-generating vehicle;

suspending control of the movements of the remote propulsion-generating vehicle based on the operational command signals responsive to receiving a suspend command signal at the remote propulsion-generating vehicle;

responsive to confirming suspension of control of the movements of the remote propulsion-generating vehicle based on the operational command signals, separating the vehicle system into a leading vehicle segment that includes the leading propulsion-generating vehicle and a remote vehicle segment that includes the remote propulsion-generating vehicle;

moving the remote vehicle segment separately from movement of the leading vehicle segment;

connecting the remote vehicle segment with the leading vehicle segment to form the vehicle system; and resuming control of the movement of the remote propulsion-generating vehicle based on the operational command signals received from the leading propulsion-generating vehicle.

18. The method of claim 17, wherein separating the vehicle system, moving the remote vehicle segment, connecting the remote vehicle segment with the leading vehicle segment, and resuming control of the movement of the remote propulsion-generating vehicle are performed without initiation of a penalty brake application.

19. The method of claim 17, further comprising operating the vehicle system to a safe state prior to suspending control of the movements of the remote propulsion-generating vehicle.

20. The method of claim 17, further comprising applying one or more brake systems of the vehicle system prior to separating the vehicle system into the lead vehicle segment and the remote vehicle segment.

21. The method of claim 17, wherein the vehicle system includes the lead and remote propulsion-generating vehicles being both mechanically and fluidly coupled with each other directly, by another propulsion-generating vehicle, or by one or more non-propulsion-generating vehicles, and wherein separating the vehicle system into the lead and remote vehicle segments includes both mechanically decoupling and fluidly decoupling the lead and remote propulsion-generating vehicles from each other.

22. The method of claim 17, wherein the vehicle system includes the lead and remote propulsion-generating vehicles being logically coupled with each other without being mechanically coupled with each other, and wherein separating the vehicle system into the lead and remote vehicle segments includes logically decoupling the lead and remote propulsion-generating vehicles from each other such that the lead and remote propulsion-generating vehicles can separately move from each other.

* * * * *